US006539690B2

(12) United States Patent
Alvarez

(10) Patent No.: US 6,539,690 B2
(45) Date of Patent: Apr. 1, 2003

(54) SEMI-AUTOMATIC FILM CUT/CLAMP DEVICE AND METHOD OF OPERATING THE SAME

(75) Inventor: Joseph Alvarez, Ft. Lauderdale, FL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/892,992

(22) Filed: Jun. 27, 2001

(65) Prior Publication Data

US 2003/0000173 A1 Jan. 2, 2003

(51) Int. Cl.[7] ..... B65B 53/00

(52) U.S. Cl. ..... 53/441; 53/556; 53/389.3; 83/924

(58) Field of Search ..... 53/399, 441, 587, 53/588, 589, 556, 389.3; 83/651.1, 171, 924

(56) References Cited

U.S. PATENT DOCUMENTS

| | | | | |
|---|---|---|---|---|
| 4,204,377 A | | 5/1980 | Lancaster et al. | |
| 4,619,102 A | * | 10/1986 | Geisinger | 53/399 |
| 5,400,575 A | | 3/1995 | Scherer | |
| 5,452,566 A | * | 9/1995 | Benhamou et al. | 53/389.3 |
| 5,572,850 A | | 11/1996 | Lancaster, III et al. | |

FOREIGN PATENT DOCUMENTS

| | | |
|---|---|---|
| EP | 0980830 | 2/2000 |

* cited by examiner

*Primary Examiner*—Ted Kavanaugh
(74) *Attorney, Agent, or Firm*—Schwartz & Weinrieb

(57) ABSTRACT

A system and method for severing a portion of a wrapping film for facilitating the detachment and attachment of trailing and leading end portions of the wrapping film from and onto loads disposed at a wrapping station in conjunction with film wrapping operations being performed upon loads being wrapped at a wrapping station comprises an actuating arm movable between retracted and extended positions and upon which a fixed clamping member and a movable clamping member are mounted such that the movable clamping member can move toward and away from the fixed clamping member so as to define therewith CLOSED and OPENED positions. Upon termination of a wrapping operation, the actuating arm is moved from its retracted position to its extended position, the clamping members are moved to their CLOSED position so as to clamp a portion of the wrapping film therebetween, and a hot-wire cutter is energized so as to sever a portion of the clamped film. A trailing end portion of the wrapping film is thus released for self-adherence to the wrapped load, while a leading end portion of the wrapping film is maintained clamped between the clamping members in preparation for self-adherence to a new load to be wrapped. When wrapping of the new load is commenced, the movable clamping member is moved to its OPENED position such that the clamped leading end portion of the wrapping film is released for self-adherence to the new load to be wrapped, and the actuating arm is returned to its retracted position.

26 Claims, 2 Drawing Sheets

SEMI-AUTOMATIC FILM CUT/CLAMP DEVICE AND METHOD OF OPERATING THE SAME

FIELD OF THE INVENTION

The present invention relates generally to article, load, or package wrapping machines, apparatus, or systems, and more particularly to a new and improved mechanism or system which is to be utilized in conjunction with such article, load, or package wrapping machines, apparatus, or systems whereby in effect the attachment of the leading edge portion of the wrapping film to the article, load, or package at the commencement of an article, load, or package wrapping cycle, as well as the detachment or severance of the trailing edge portion of the wrapping film from the article, load, or package at the termination of the article, load, or package wrapping cycle, can be achieved in a semiautomatic manner obviating the need for operator personnel to physically, personally, or manually attach or sever the leading and trailing edge portions of the wrapping film to or from the article, load, or package, respectively.

BACKGROUND OF THE INVENTION

Article, load, or package wrapping machines, apparatus, or systems for wrapping articles, loads, or packages within a suitable wrapping film are of course well-known. In accordance with such article, load, or package wrapping machines, apparatus, or systems, a roll of packaging film is normally mounted upon a film roll carriage, and the film roll carriage is movably mounted, for example, upon an upstanding mast or track member, such that the film roll carriage, having the roll of wrapping film mounted thereon, can be vertically moved between uppermost and lowermost positions while also undergoing relative rotatable movement with respect to the article, load, or package. In this manner, spiral wrapping of the film upon the article, load, or package is able to be achieved in a well-known manner. In order to minimize article, load, or package wrapping cycle time, and therefore maximize article, load, or package wrapping production, that is, the number of articles, loads, or packages that can be wrapped or packaged within a predetermined period of time, it is desirable to, in effect, automate the article, load, or package wrapping cycle as much as possible. One operative part or section of such article, load, or package wrapping cycle in which strides have sought to have been made in order to enhance the automation of the wrapping cycle resides in the attachment or securing, and the detachment or severing, of the end portions of the wrapping film onto and from the particular article, load, or package being wrapped. An automated system of this type is disclosed, for example, within U.S. Pat. No. 5,572,850 which issued to Lancaster, III et al. on Nov. 12, 1996. In accordance with the operative system disclosed within such patent, in order to sever or separate a trailing end portion of the wrapping film 34, which is already wrapped around a load 32, a puncturing device 62 having a plurality of sharp pins 64 is activated such that the sharp pins 64 puncture the trailing end portion of the wrapping film in order to effectively weaken the same. The film delivery or dispensing drive motor 54 is no longer driven, however, the turntable 58, upon which the packaged or wrapped load is disposed, continues to rotate. Consequently, the weakened film is tensioned and stretched, the holes or perforations increase in size, and eventually, the film tears at the weakened sites defined by the punctured holes.

While the aforenoted system is quite satisfactory and has been commercially successful, the system exhibits several operational drawbacks or disadvantages. Firstly, the system is relatively costly and complex. For example, as disclosed within the noted patent, in order to achieve the proper operation of the system, at least three different timer devices or mechanisms must be incorporated or implemented into the system. In particular, a first timer 76*a* is required in order to decelerate the film delivery drive motor 54 and turntable 58 in preparation for the initiation of the hole puncturing operation to be performed upon the trailing end portion of the wrapping or packaging film, a second timer 76*b* is required for controlling the solenoid 68 in order to in turn control the actuation of the puncturing device 62, and a third timer 76*c* is required for controlling the termination of the film delivery drive motor 54 such that the aforenoted tensioning and stretching of the punctured wrapping or packaging film occurs in order to achieve the torn separation of the trailing edge portion of the wrapping or packaging film from the roll of wrapping or packaging film. Secondly, while the semi-automatic wrapping apparatus or system disclosed within the aforenoted patent is utilized to detach, terminate, or sever the trailing end portion of the wrapping or packaging film from the roll of wrapping or packaging film, there is no corresponding means or mechanism for securing, initiating, or attaching the leading end portion of the wrapping or packaging film to the article, load, or package to be wrapped or packaged in a semi-automatic operational mode. More particularly, in accordance with the disclosure of the aforenoted patent, in order to initiate a new wrapping or packaging cycle, an operator must grasp the free leading end portion 70 of the wrapping or packaging film, which is complementary to the trailing end portion of the wrapping or packaging film as formed by means of the aforenoted tearing or separating process facilitated by the puncturing, tensioning, and stretching of the film, and manually apply or secure such free leading end portion 70 of the wrapping or packaging film to the particular article, load, or package to be subsequently wrapped or packaged.

Accordingly, a need exists in the art for a new and improved mechanism or system which can be utilized in conjunction with article, load, or package wrapping apparatus, machines, or systems whereby in effect the attachment of the leading edge portion of the wrapping film to the article, load, or package at the commencement of an article, load, or package wrapping cycle, as well as the detachment or severance of the trailing edge portion of the wrapping film from the article, load, or package at the termination of the article, load, or package wrapping cycle, can be achieved in a semi-automatic manner obviating the need for operator personnel to physically, personally, or manually attach or sever the leading and trailing end portions of the wrapping film to or from the article, load, or package, respectively.

OBJECTS OF THE INVENTION

Accordingly, it is an object of the present invention to provide a new and improved mechanism or system which is to be utilized in conjunction with package, load, or article wrapping machines, apparatus, or systems for implementing the attachment or securement of a leading end portion of a wrapping or packaging film to an article, load, or package to be wrapped or packaged so as to prepare for the commencement of a film wrapping or packaging operation or cycle, as well as the detachment or severance of a trailing end portion of the wrapping or packaging film from the wrapped or packaged article, load, or package upon termination of the wrapping or packaging operation or cycle.

Another object of the present invention is to provide a new and improved mechanism or system which is to be utilized in conjunction with package, load, or article wrapping machines, apparatus, or systems for implementing the attachment or securement of the leading end portion of the wrap-ping or packaging film to the article, load, or package to be wrapped or packaged so as to prepare for the commencement of the film wrapping or packaging operation or cycle, as well as the detachment or severance of the trailing end portion of the wrapping or packaging film from the wrapped or packaged article, load, or package upon termination of the wrapping or packaging operation or cycle, and which effectively overcomes the various operational drawbacks or disadavantages characteristic of the prior art systems.

An additional object of the present invention is to provide a new and improved mechanism or system which is to be utilized in conjunction with package, load, or article wrapping machines, apparatus, or systems for implementing the attachment or securement of the leading end portion of the wrapping or packaging film to the package, load, or article to be wrapped or packaged so as to prepare for the commencement of the film wrapping or packaging operation or cycle, as well as the detachment or severance of the trailing end portion of the wrapping or packaging film from the wrapped or packaged article, load, or package upon termination of the wrapping or packaging operation or cycle, and which is relatively simple in structure and economical to produce.

A further object of the present invention is to provide a new and improved mechanism or system which is to be utilized in conjunction with package, load, or article wrapping machines, apparatus, or systems for implementing the attachment or securement of the leading edge portion of the wrapping film to the article, load, or package to be wrapped or packaged so as to prepare for the commencement of the film wrapping or packaging operation or wrapping cycle, as well as the detachment or severance of the trailing edge portion of the wrapping or packaging film from the package, load, or article upon termination of the article, load, or package wrapping or packaging operation or cycle, in a semiautomatic manner thereby obviating the need for operator personnel to physically, personally, or manually attach or sever the leading and trailing end portions of the wrapping film to or from the article, load, or package, respectively.

SUMMARY OF THE INVENTION

The foregoing and other objectives are achieved in accordance with the teachings and principles of the present invention through the provision of a new and improved mechanism or system which comprises a vertically upstanding stanchion or standard upon which a proximal end portion of an actuating arm is pivotally mounted. The actuating arm is pivotally movable between a first inoperative retracted position at which the actuating arm is disposed remote from the flow path of the wrapping or packaging film as the wrapping or packaging film is dispensed from the roll of wrapping or packaging film and wrapped around a load, article, or package disposed at a wrapping station, and a second operative extended position at which the actuating arm is disposed adjacent to the flow path of the wrapping or packaging film. A vertically oriented support plate is fixedly mounted upon a distal end portion of the actuating arm, and a first clamping plate is fixedly mounted upon an upper portion of the support plate. The first clamping plate has an electrically energizable cutting wire mounted thereon, and a second clamping plate is movably mounted upon the vertically oriented support plate. More particularly, the second clamping plate is movable between a first lowered inoperative position, and a second elevated operative position at which the second clamping plate is adapted to cooperate with the first clamping plate so as to clamp a portion of the wrapping or packaging film therebetween.

Accordingly, when a wrapping or packaging operation or cycle is to be terminated, the actuating arm is moved from its first inoperative retracted position remote from the wrapping or packaging film flow path to its second operative extended position adjacent to the wrapping or packaging film flow path, and the second clamping plate is moved from its first lowered inoperative position to its second elevated operative position so as to cooperate with the first clamping plate and thereby clamp a portion of the wrapping or packaging film therebetween. At this time, the cutting wire is energized, and the clamped portion of the packaging or wrapping film is thereby severed. In this manner, the severed trailing end portion of the packaging or wrapping film extending from the packaged or wrapped article, load, or package is able to be secured to the packaged or wrapped article, load, or package, while the severed leading end portion of the packaging or wrapping film extending from the roll of wrapping or packaging film is held or maintained between the first and second clamping plates in preparation for the commencement of a new packaging or wrapping operation or cycle to be performed upon or in connection with a new article, load, or package to be wrapped or packaged when a new article, load, or package to be wrapped or packaged is conveyed to or deposited at the wrapping or packaging station.

Subsequently, the actuating arm is moved or returned to its remote or retracted position with respect to the packaging or wrapping film flow path, and when a new article, load, or package to be wrapped or packaged has been conveyed to or deposited at the wrapping or packaging station, the actuating arm, still having the leading end portion of the wrapping or packaging film held or maintained between its clamping plates, is then moved again to its operative extended position adjacent to the packaging or wrapping film flow path. When a new packaging or wrapping operation or cycle has been partially commenced in connection with the new article, load, or package, the second lower clamping plate is moved downwardly away from the first upper clamping plate such that the leading end portion of the packaging or wrapping film held or maintained between the first and second clamping plates is now released, the new packaging or wrapping operation or cycle being performed upon or in connection with the new article, load, or package is continued, and the actuating arm is moved from its second operative extended position adjacent to the wrapping or packaging film flow path so as to again be returned to its first inoperative retracted position remote from the packaging or wrapping film flow path. When the new packaging or wrapping operation or cycle is to be terminated, the actuating arm will once again be moved from its first inoperative retracted position back to its second operative extended position adjacent to the wrapping or packaging film flow path in preparation for a clamping and severing operation whereby the operating cycles are cyclically repeated.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
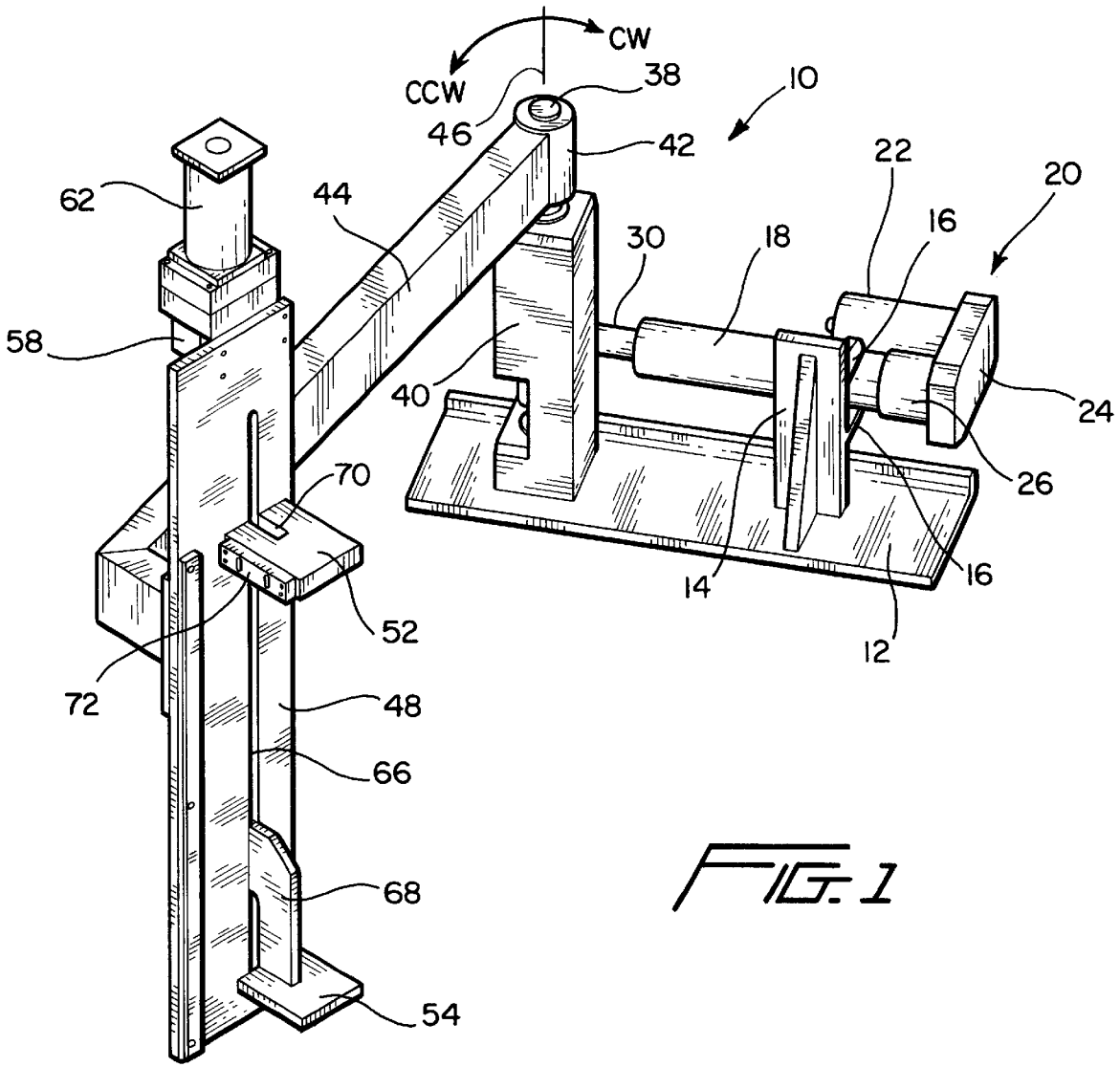
FIG. 1 is a front perspective view of a new and improved mechanism or system which is to be utilized in conjunction with package, load, or article wrapping machines, apparatus, or systems for implementing the attachment or securement of the leading edge portion of the wrapping film to the article, load, or package to be wrapped or packaged so as to prepare for the commencement of the film wrapping or packaging operation or wrapping cycle, as well as the detachment or severance of the trailing edge portion of the wrapping or packaging film from the package, load, or article upon termination of the article, load, or package wrapping or packaging operation or cycle, in a semi-automatic manner thereby obviating the need for operator personnel to physically, personally, or manually attach or sever the leading and trailing end portions of the wrapping film to or from the article, load, or package, respectively, the actuating arm being disclosed, for example, at its extended position.
Figure 2:
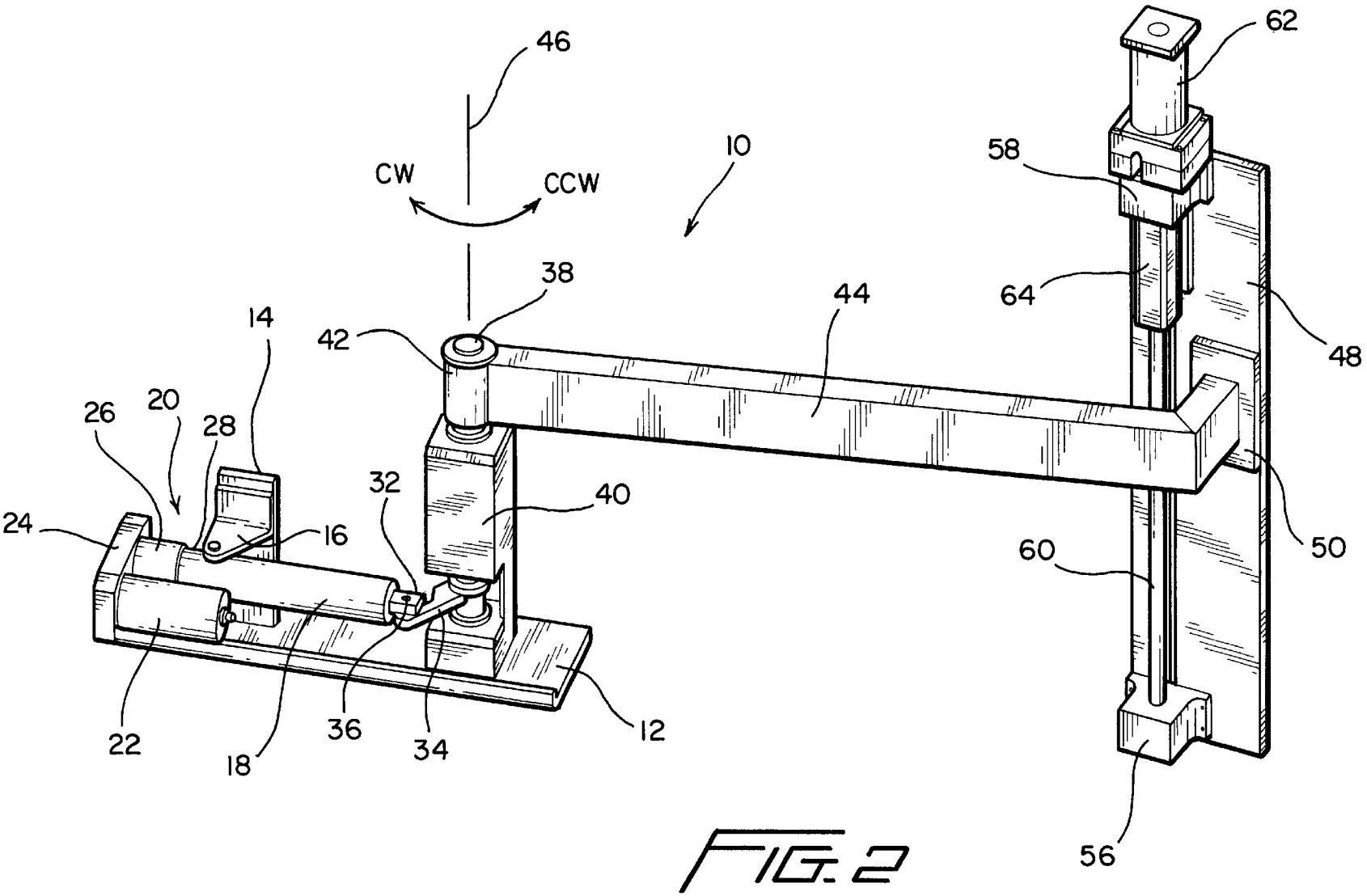
FIG. 2 is a rear perspective view of the new and improved mechanism or system as disclosed within FIG. 1 wherein the actuating arm is disclosed at its retracted position.

Referring now to the drawings, and more particularly to FIGS. 1 and 2 thereof, a new and improved mechanism or system, which is to be utilized in conjunction with package, load, or article wrapping machines, apparatus, or systems for implementing the attachment or securement of a leading edge portion of the wrapping film to the article, load, or package to be wrapped or packaged so as to prepare for the commencement of the film wrapping or packaging operation or wrapping cycle, as well as the detachment or severance of a trailing edge portion of the wrapping or packaging film from the package, load, or article upon termination of the article, load, or package wrapping or packaging operation or cycle, in a semi-automatic manner so as to obviate the need for operator personnel to physically, personally, or manually attach or sever the leading and trailing end portions of the wrapping film to or from the article, load, or package, respectively, is disclosed and is generally indicated by the reference character 10. More particularly, the new and improved mechanism or system 10 is seen to comprise a base member 12 upon a first end of which there is fixedly mounted an upstanding support bracket 14. The upstanding support bracket 14 is provided with a pair of vertically spaced bracket lugs or ears 16 for fixedly mounting a cylinder member 18 of an electrical linear actuator assembly 20. The electrical linear actuator assembly 20 is seen to further comprise an electrical linear actuator drive motor 22 which is mounted upon a support block 24, and the electrical linear actuator drive motor 22 is rotatably engaged with a rotatably driven member 26 which is also mounted upon the support block 24 and which forms part of a combination rotary-rectilinear conversion drive unit 28.

The combination rotary-rectilinear conversion drive unit 28, in turn, includes a piston member 30 which is operatively engaged with the rotatably driven member 26 so as to be linearly movable interiorly of and with respect to the external cylinder member 18 in response to rotational movements of the rotatably driven member 26. In this manner, as the electrical linear actuator drive motor 22 is rotated in a first direction, rotatably driven member 26 is rotated in an opposite direction so as to, for example, cause the piston member 30 to be linearly extended with respect to the cylinder member 18, whereas when the electrical linear actuator drive motor 22 is rotated in a second direction, which is opposite to its first rotational or angular direction, rotatably driven member 26 is rotated in a second opposite direction so as to, for example, cause the piston member 30 to be linearly retracted with respect to the cylinder member 18. It is further noted that the free end portion of the piston member 30 is integrally provided with a connector plate 32, and that the connector plate 30 is adapted to be pivotally secured or attached to a lug or ear member 34 by means of a connector pin 36. The lug or ear member 34 is fixedly mounted upon and projects radially outwardly from a lower end portion of a vertically extending externally splined shaft 38. The vertically extending externally splined shaft 38 is internally housed for rotational or angular movement within a vertically oriented stanchion 40 which is fixed at its lower end portion upon the base member 12. The upper end portion of the vertically extending externally splined shaft 38 projects vertically outwardly from and above the upper end portion of the stanchion 40, and in this manner, the upper end portion of the externally splined shaft 38 is adapted to be internally housed within and splinedly mated with an internally splined annular cap member 42. The internally splined cap member 42 is integrally formed upon a proximal end of a horizontally extending actuating arm 44, and the horizontally extending actuating arm 44 is adapted to undergo pivotal movement in accordance with the double arrowhead CW-CCW around the vertical axis 46 defined by means of the upwardly extending externally splined shaft 38.

More particularly, it can be readily appreciated that when the electrical linear actuator assembly 20 is energized such that the piston member 30 is moved to its extended position as shown in FIG. 1, actuating arm 44 is rotated in the counterclockwise direction around vertical axis 46 as denoted by arrow CCW so as to be moved to its extended position as shown in FIG. 1 through means of the pivotal or rotational movements of the lug or ear member 34, upstanding externally splined shaft 38, and annular internally splined cap member 42. Conversely, when the electrical linear actuator assembly 20 is energized such that the piston member 30 is moved to its retracted position as shown in FIG. 2, actuating arm 44 is rotated in the clockwise direction around vertical axis 46 as denoted by the arrow CW so as to be moved to its retracted position as shown in FIG. 2 through means of the opposite pivotal or rotational movements of the lug or ear member 34, upstanding externally splined shaft 38, and annular internally splined cap member 42.

A vertically oriented support plate 48 is fixedly mounted upon the distal end portion of the actuating arm 44 through means of a mounting plate 50, and as best seen in FIG. 1, a first film clamping plate 52 is fixedly mounted upon an upper portion of the front face of the support plate 48, while a second film clamping plate 54 is adapted to be movably mounted upon the front face of the support plate 48 so as to be disposed, for example, either at a first lowermost position with respect to the upper clamping plate 52, or at a second uppermost position with respect to the upper clamping plate 52. It can readily be appreciated then that when the second film clamping plate 54 is disposed at its first lowermost position with respect to the first film clamping plate 52, the clamping plates 52,54 are disposed at relative OPEN positions with respect to each other such that a portion of a wrapping or packaging film can be interposed therebetween in preparation for a clamping operation to be performed upon such portion of the wrapping or packaging film, or that a portion of the wrapping or packaging film, which has been previously clamped between the clamping plates 52,54 can now be released from its clamped or retained position or state between the clamping plates 52,54. Alternatively, of course, when the second film clamping plate 54 is disposed at its second uppermost position with respect to the first film clamping plate 52, the clamping plates 52,54 are disposed at relative CLOSED positions with respect to each other such that a portion of a wrapping or packaging film interposed between the clamping plates 52,54 is either clamped in preparation for a film severing operation to be performed upon such portion of the wrapping or packaging film, or that a portion of the wrapping or packaging film, which has been previously severed, is retained between the clamping plates 52,54 in preparation for the commencement of a new wrapping or packaging operation or cycle.

Continuing further, in order to movably mount the second film clamping plate 54 upon the vertically oriented support plate 48, a first lower mounting block 56 is fixedly mounted upon a lower portion of the rear surface of the vertically oriented support plate 48, while a second upper mounting block 58 is likewise fixedly mounted upon an upper portion of the rear surface of the vertically oriented support plate 48 as best seen in FIG. 2. A vertically oriented acme screw shaft 60 is rotatably mounted within the lower and upper mounting blocks 56,58, and a drive motor 62 is mounted atop the upper mounting block 58. A vertically movable carriage 64 is mounted upon the acme screw shaft 60, and the drive motor 62 is operatively connected to the acme screw shaft 60 such that when the drive motor 62 is energized so as to alternatively rotatably drive the acme screw shaft 60 in opposite angular or rotational directions, the carriage 64 will be accordingly driven in upward and downward directions along the acme screw shaft 60. As best seen in FIG. 1, the vertically oriented support plate 48 is also provided with a vertically oriented through-slot 66, and a bracket member 68, having a substantially inverted L-shaped configuration and fixedly interconnecting a forward-facing portion of the carriage 64 to the lower clamping plate 54, is adapted to pass through the vertically oriented slot 66 defined within the vertically oriented support plate 48.

In this manner, it can be readily appreciated that the lower clamping plate 54 is able to be moved upwardly and downwardly between its extreme CLOSED and OPENED positions with respect to the upper fixed clamping plate 52 by means of the carriage drive system or assembly comprising drive motor 62, lower and upper mounting blocks 56,58, acme drive screw shaft 60, carriage 64, and connecting bracket 68. It is further noted that, in conjunction with the aforenoted structure comprising the carriage drive system or assembly for operatively moving the lower clamping plate 54, and in order to permit the lower clamping plate 54 to be moved into gripping or clamping contact with the upper clamping plate 52, the upper clamping plate 52 is provided with a through-slot 70. Through-slot 70 can therefore accommodate that part of the connecting bracket 68, which projects through the through-slot 66 defined within the vertically oriented support plate 48 and which connects to the lower clamping plate 54, when the lower clamping plate 54 is moved upwardly to its uppermost clamping position with respect to upper clamping plate 52. It is lastly noted that upper clamping plate 52 is provided with an electrically energizable hot wire or cutting wire mechanism 72 which, when suitably energized, can cut or sever that portion of the wrapping or packaging film which is gripped or clamped between the upper and lower clamping plates 52,54 when the lower clamping plate 54 has been moved to its uppermost clamping position with respect to the upper clamping plate 52.

Having now described all of the structural components comprising the new and improved mechanism or system 10 which is to be utilized in conjunction with package, load, or article wrapping machines, apparatus, or systems for implementing the attachment or securement of a leading edge portion of the wrapping film to the article, load, or package to be wrapped or packaged in preparation for the commencement of a film wrapping or packaging operation or wrapping cycle, as well as the detachment or severance of a trailing edge portion of the wrapping or packaging film from the package, load, or article upon termination of the article, load, or package wrapping or packaging operation or cycle, the operation of the new and improved mechanism or system 10 will now be described. Assuming that a particular article, load, or package has been previously disposed at a wrapping station, not shown, and that, for example, a rotatable wrapping arm of a wrapping machine, also not shown, has been rotated around the wrapping station in order to spiral wrap the article, load, or package, then upon termination of the wrapping operation or cycle, rotational movement of the wrapping arm is terminated. The electrical linear actuator drive motor 22 is now energized whereby, through means of rotary-linear conversion drive unit 28, piston 30, and driven splined members 38,42, actuating arm 44 is now moved from its retracted position as shown in FIG. 2 toward its extended position as shown in FIG. 1. When the actuating arm 44 has reached its fully extended position, which may be predetermined, for example, by means of a suitable proximity switch, not shown, energization of the electrical linear actuator drive motor 22 is terminated and the upper and lower clamping plates 52,54 are now disposed substantially adjacent to the wrapping or packaging film flow path or locus as determined by means of the wrapping machine wrapping arm, not shown, whereby the upper and lower clamping plates 52,54 will be disposed, in effect, above and below a portion of the wrapping or packaging film which extends from the wrapped or packaged article, load, or package to the roll of wrapping or packaging film disposed upon a carriage member, not shown, mounted upon the wrapping machine wrapping arm, also not shown, in a manner well-known in the art.

Accordingly, drive motor 62 can now be energized so as to move the carriage 64, and therefore the lower clamping plate 54 attached thereto, from its lowermost position toward its uppermost position with respect to the upper clamping plate 52. In this manner, that portion of the wrapping or packaging film which is interposed between the upper and lower clamping plates 52,54 is now vertically compressed or crimped together in a clamped or gripped fashion between the upper and lower clamping plates 52,54, and the drive movement of the drive motor 62, and therefore the upward movement of the lower clamping plate 54, is then terminated by means of another suitable proximity switch, not shown. Hot wire cutting mechanism 72 can now be energized whereby the clamped or crimped portion of the wrapping or packaging film is then severed whereby the severed trailing edge portion of the wrapping or packaging film wrapped around the particular article, load, or package, is simply applied or secured to the article, load, or package under the influence of gravity and its self-adherent properties. The corresponding or complementary severed leading edge portion of the wrapping or packaging film is still retained by the CLOSED clamping plates 52,54 in preparation for the commencement of a new wrapping or packaging operation or cycle to be performed upon or in connection with a new load, article, or package to wrapped or packaged.

Accordingly, electrical linear actuator drive motor 22 is again energized so as to move the actuating arm 44 from its extended position, as shown in FIG. 1, back to its retracted position, as shown in FIG. 2, in order to permit a new article, load, or package, to be wrapped or packaged, to be placed at the wrapping station. An operational START button, not shown, is then pressed by the operator upon, for example, a remote console or the like, and accordingly, the wrapping film roll carriage, not shown, mounted upon the wrapping machine wrapping arm, also not shown, is moved upwardly, for example, so as to initiate the wrapping or packaging operation or cycle at the top of the article, load, or package being wrapped or packaged. At the same time, electrical linear actuator drive motor 22 is again energized so as to again move the actuating arm 44 from its retracted position, as shown in FIG. 2, to its extended position as shown in FIG. 1. The clamping plates 52,54, still disposed at their relative CLOSED position and therefore still retaining the crimped or clamped leading end portion of the wrapping or packaging film therebetween, are therefore now disposed adjacent the packaging or wrapping film flow path or locus. The packaging or wrapping film now extends, in effect, from the clamping plates 52,54 to the film roll mounted upon the vertically movable carriage, not shown, disposed upon the wrapping arm, also not shown, of the wrapping machine.

At this time, the wrapping arm, not shown, of the wrapping machine is rotated through means of an angular rotation of approximately three-quarters of one revolution, or approximately 270°, and is then momentarily stopped. Drive motor 62 is then energized so as to move lower clamping plate 54 to its OPENED position with respect to upper clamping plate 52 whereby the clamped or crimped leading edge portion of the packaging or wrapping film is now released and permitted to fall under the influence of gravity whereby such leading edge portion of the packaging or wrapping film will in effect self-adhere to the new package, load, or article being wrapped. Electrical linear actuator drive motor 22 is now again energized so as to move the actuating arm 44 back to its retracted position as shown in FIG. 2 from its extended position as shown in FIG. 1, and the wrapping arm, not shown, of the wrapping machine is once again energized so as to complete the particular wrapping or packaging operation or cycle. Upon completion of the entire package, load, or article wrapping or packaging operation, rotational movement of the wrapping machine wrapping arm, not shown, is terminated, an entire operational cycle has been completed, and an entirely new operational cycle may be initiated or implemented.

Thus, it may be seen that in accordance with the principles and teachings of the present invention, there has been provided a new and improved mechanism or system, which can be utilized in conjunction with package, load, or article wrapping machines, apparatus, or systems for implementing the attachment or securement of a leading edge portion of the wrapping film to the article, load, or package to be wrapped or packaged so as to prepare for the commencement of the film wrapping or packaging operation or wrapping cycle, as well as the detachment or severance of a trailing edge portion of the wrapping or packaging film from the package, load, or article upon termination of the article, load, or package wrapping or packaging operation or cycle, in a semiautomatic manner so as to obviate the need for operator personnel to physically, personally, or manually attach or sever the leading and trailing end portions of the wrapping or packaging film to or from the article, load, or package, respectively.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A system for severing a portion of a wrapping film for facilitating the attachment and detachment of leading and trailing end portions of the wrapping film onto and from loads disposed at a wrapping station in conjunction with film wrapping operations performed upon loads to be wrapped, comprising:

an actuating arm having a first end portion thereof pivotally mounted for movement around a vertical axis so as to be substantially movable within a horizontal plane between a first retracted position remote from a wrapping film flow path locus, and a second extended position adjacent to the wrapping film flow path locus;

a first motor drive operatively connected to said actuating arm for pivotally moving said actuating arm between said first retracted and second extended positions;

first and second clamping members mounted upon a second opposite end portion of said actuating arm for relative movement with respect to each other between a first CLOSED position at which a portion of the wrapping film can be clamped between said first and second clamping members, and a second OPENED position at which a portion of the wrapping film can alternatively be firstly inserted between said first and second clamping members in preparation for being clamped therebetween when said first and second clamping members are subsequently disposed at said first CLOSED position, and be secondly released from said first and second clamping members;

a second motor drive operatively connected to at least one of said first and second clamping members for moving said at least one of said first and second clamping members toward and away from the other one of said first and second clamping members such that said first and second clamping members can achieve said first OPENED and second CLOSED positions; and a cutter device operatively disposed adjacent to one of said first and second clamping members for severing a portion of the wrap-ping film clamped between said first and second clamping members so as to free a trailing end portion of a wrapping film extending from a load being wrapped at the wrapping station, and for permitting said first and second clamping members to retain a leading end portion of the wrapping film in preparation for a new wrapping operation.

2. The system as set forth in claim 1, further comprising:

a base member;

an upstanding support bracket fixedly mounted upon said base member;

an upstanding stanchion fixedly mounted upon said base member;

a drive shaft rotatably mounted within said upstanding stanchion and operatively connected to a first proximal end of said actuating arm; and a drive unit mounted upon said upstanding support bracket and operatively interconnecting said first motor drive to said drive shaft for moving said actuating arm between said first retracted and second extended positions.

3. The system as set forth in claim 2, wherein:

an internally splined annular cap member is provided upon said proximal end of said actuating arm; and said drive shaft comprises an externally splined drive shaft for splined engagement with said internally splined annular cap member of said actuating arm.

4. The system as set forth in claim 2, wherein said drive unit comprises:

a cylinder member fixedly mounted upon said upstanding support bracket;

a rotary driven member operatively connected to said first motor drive; and a piston member disposed within said cylinder, operatively connected at a first end thereof to said rotary driven member, and operatively connected at a second end thereof to said drive shaft rotatably mounted within said stanchion.

5. The system as set forth in claim 1, further comprising:

a vertically oriented support plate mounted upon a second distal end of said actuating arm, said first and second clamping members being mounted upon said vertically oriented support plate.

6. The system as set forth in claim 5, wherein:

said first clamping member is fixedly mounted upon said vertically oriented support plate; and said second clamping member is movably mounted upon said vertically oriented support plate so as to be movable toward and away from said fixedly mounted first clamping member between an uppermost position corresponding to said first CLOSED position with respect to said first clamping member at which the portion of the wrapping film can be clamped between said first and second clamping members, and a lowermost position corresponding to said second OPENED position with respect to said first clamping member at which the portion of the wrapping film can alternatively be firstly inserted between said first and second clamping members in preparation for being clamped therebetween when said first and second clamping members are subsequently disposed at said first CLOSED position, and be secondly released from said first and second clamping members.

7. The system as set forth in claim 6, wherein:

said cutter device comprises an electrically energizable hot-wire type cutter device.

8. The system as set forth in claim 7, wherein:

said hot-wire type cutter device is mounted upon said first fixedly mounted clamping member.

9. The system as set forth in claim 6, wherein:

said vertically oriented support plate has a through-slot defined therein;

said first and second clamping members are respectively fixedly and movably mounted upon a front surface portion of said vertically oriented support plate;

said second motor drive is mounted upon a rear surface portion of said vertically oriented support plate; and a bracket member extends through said through-slot defined within said vertically oriented support plate so as to operatively connect said second motor drive to said second movably mounted clamping plate.

10. The system as set forth in claim 9, further comprising:

first and second mounting blocks mounted upon said rear surface portion of said vertically oriented support plate;

said second motor drive is mounted upon one of said first and second mounting blocks;

a screw shaft member operatively connected to said second motor drive and rotatably mounted within said first and second mounting blocks; and a carriage, having said bracket member mounted thereon, mounted upon said screw shaft member for vertical movement along said screw shaft member, in response to rotation of said screw shaft member by said second motor drive, in order to move said second movably mounted clamping member between said lowermost and uppermost positions.

11. Semi-automatic apparatus for severing a portion of a wrapping film so as to facilitate the attachment and detachment of leading and trailing end portions of the wrapping film onto and from loads disposed at a wrapping station in conjunction with film wrapping operations performed upon loads to be wrapped, comprising:

an actuating arm movable between a first retracted position remote from a wrapping film flow path locus, and a second extended position adjacent to the wrapping film flow path locus;

a first motor drive operatively connected to said actuating arm for moving said actuating between said first retracted and second extended positions;

first and second clamping members mounted upon said actuating arm for relative movement with respect to each other between a first CLOSED position at which a por-tion of the wrapping film can be clamped between said first and second clamping members, and a second OPENED position at which a portion of the wrapping film can alternatively be firstly inserted between said first and second clamping members in preparation for being clamped therebetween when said first and second clamping members are subsequently disposed at said first CLOSED position, and be secondly released from said first and second clamping members;

a second motor drive operatively connected to at least one of said first and second clamping members for moving said at least one of said first and second clamping members toward and away from the other one of said first and second clamping members such that said first and second clamping members can achieve said first OPENED and second CLOSED positions; and a cutter device mounted upon one of said first and second clamping members for severing a portion of the wrapping film clamped between said first and second clamping members so as to free a trailing end portion of a wrapping film extending from a load being wrapped at the wrapping station, and for permitting said first and second clamping members to retain a leading end portion of the wrapping film in preparation for a new wrapping operation, whereby the need for operator personnel to manually attach and sever the leading and trailing end portions of the wrapping film to and from the article, load, or package, respectively, is obviated.

12. The apparatus as set forth in claim 11, further comprising:

a vertically oriented support plate mounted upon a second distal end of said actuating arm, said first and second clamping members being mounted upon said vertically oriented support plate.

13. The apparatus as set forth in claim 12, wherein:

said first clamping member is fixedly mounted upon said vertically oriented support plate; and said second clamping member is movably mounted upon said vertically oriented support plate so as to be movable toward and away from said fixedly mounted first clamping member between an uppermost position corresponding to said first CLOSED position with respect to said first clamping member at which the portion of the wrapping film can be clamped between said first and second clamping members, and a lowermost position corresponding to said second OPENED position with respect to said first clamping member at which the portion of the wrapping film can alternatively be firstly inserted between said first and second clamping members in preparation for being clamped therebetween when said first and second clamping members are subsequently disposed at said first CLOSED position, and be secondly released from said first and second clamping members.

14. The apparatus as set forth in claim 13, wherein:

said cutter device comprises an electrically energizable hot-wire type cutter device.

15. The apparatus as set forth in claim 14, wherein:

said hot-wire type cutter device is mounted upon said first fixedly mounted clamping member.

16. The apparatus as set forth in claim 13, wherein:

said vertically oriented support plate has a through-slot defined therein;

said first and second clamping members are respectively fixedly and movably mounted upon a front surface portion of said vertically oriented support plate;

said second motor drive is mounted upon a rear surface portion of said vertically oriented support plate; and a bracket member extends through said through-slot defined within said vertically oriented support plate so as to operatively connect said second motor drive to said second movably mounted clamping plate.

17. The apparatus as set forth in claim 16 further comprising:

first and second mounting blocks mounted upon said rear surface portion of said vertically oriented support plate;

said second motor drive is mounted upon one of said first and second mounting blocks;

a screw shaft member operatively connected to said second motor drive and rotatably mounted within said first and second mounting blocks; and a carriage, having said bracket member mounted thereon, mounted upon said screw shaft member for vertical movement along said screw shaft member, in response to rotation of said screw shaft member by said second motor drive, in order to move said second movably mounted clamping member between said lowermost and uppermost positions.

18. The apparatus as set forth in claim 11, further comprising:

a base member;

an upstanding support bracket fixedly mounted upon said base member;

an upstanding stanchion fixedly mounted upon said base member;

a drive shaft rotatably mounted within said upstanding stanchion and operatively connected to a first proximal end of said actuating arm; and a drive unit mounted upon said upstanding support bracket and operatively interconnecting said first motor drive to said drive shaft for moving said actuating arm between said first retracted and second extended positions.

19. The apparatus as set forth in claim 18, wherein:

an internally splined annular cap member is provided upon said proximal end of said actuating arm; and said drive shaft comprises an externally splined drive shaft for splined engagement with said internally splined annular cap member of said actuating arm.

20. The apparatus as set forth in claim 18, wherein said drive unit comprises:

a cylinder member fixedly mounted upon said upstanding support bracket;

a rotary driven member operatively connected to said first motor drive; and a piston member disposed within said cylinder, operatively connected at a first end thereof to said rotary driven member, and operatively connected at a second end thereof to said drive shaft rotatably mounted within said stanchion.

21. A method of severing a portion of a wrapping film for facilitating the detachment and attachment of trailing and leading end portions of the wrapping film from and onto loads disposed at a wrapping station in conjunction with film wrapping operations being performed upon loads being wrapped at a wrapping station, comprising the steps of:

mounting first and second clamping members upon distal end portions of an actuating arm such that said first and second clamping members are relatively movable with respect to each other between a first OPENED position and a second CLOSED position;

pivotally moving said actuating arm around a proximal end portion defining a vertical axis and within a substantially horizontal plane from a first retracted position remote from a wrapping film flow path locus to a second extended position adjacent to the wrapping film flow path locus;

moving at least one of said first and second clamping members toward the other one of said first and second clamping members such that said first and second clamping members achieve said second CLOSED position so as to clamp a portion of a wrapping film, disposed along the wrapping film flow path locus, therebetween;

actuating a cutter device, operatively disposed adjacent to one of said first and second clamping members, so as to sever a portion of the wrapping film clamped between said first and second clamping members and thereby free a trailing end portion of the wrapping film extending from a load being wrapped at the wrapping station such that the trailing end portion of the wrapping film can self-adhere to the wrapped load at the wrapping station, as well as to retrain a leading end portion of the wrapping film extending to a supply of wrapping film in preparation for a new wrapping operation to be performed upon a new load to be wrapped at the wrapping station;

pivotally moving said actuating arm from said second extended position, adjacent to the wrapping film flow path locus, back to said first retracted position, remote from the wrapping film flow path locus, while said first and second clamping members are maintained at said relatively CLOSED position, such that the leading end portion of the wrapping film is maintained in a clamped condition between said first and second clamping members, so as to permit a new load to be wrapped to be disposed at the wrapping station;

moving said actuating arm from said first retracted position, remote from the wrapping film flow path locus, back to said second extended position, adjacent to the wrapping film flow path locus, while said first and second clamping members are maintained at said relatively CLOSED position, such that the leading end portion of the wrapping film is maintained in a clamped condition between said first and second clamping members; and moving said at least one of said first and second clamping members away from said other one of said first and second clamping members such that said first and second clamping members achieve said first OPENED position so that the clamped leading end portion of the wrapping film is released from its clamped position between said first and second clamping members and permitted to self-adhere to the new load to be wrapped at the wrapping station in conjunction with the performance of a new wrapping operation being performed upon the new load to be wrapped at the wrapping station.

22. The method as set forth in claim 21, further comprising the step of:

said at least one of said first and second clamping members is moved away from said other one of said first and second clamping members, such that said first and second clamping members achieve said first OPENED position whereupon the clamped leading end portion of the wrapping film is released from its clamped position between said first and second clamping members so as to self-adhere to the new load to be wrapped at the wrapping station, subsequent to a predetermined amount of wrapping film being wrapped around the new load to be wrapped at the wrapping station.

23. The method as set forth in claim 22, further comprising the step of:

moving said actuating arm from said second extended position, adjacent to the wrapping film flow path locus, back to said first retracted position, remote from the wrapping film flow path locus, subsequent to said movement of said first and second clamping members to said first OPENED position and to the predetermined amount of wrapping film being wrapped around the new load to be wrapped at the wrapping station.

24. A method of severing a portion of a wrapping film for facilitating the detachment and attachment of trailing and leading end portions of the wrapping film from and onto loads disposed at a wrapping station in conjunction with film wrapping operations being performed upon loads being wrapped at a wrapping station, comprising the steps of:

mounting first and second clamping members upon an actuating arm such that said first and second clamping members are relatively movable with respect to each other between a first OPENED position and a second CLOSED position;

moving said actuating arm from a first retracted position remote from a wrapping film flow path locus to a second extended position adjacent to the wrapping film flow path locus;

moving at least one of said first and second clamping members toward the other one of said first and second clamping members such that said first and second clamping members achieve said second CLOSED position so as to clamp a portion of a wrapping film, disposed along the wrapping film flow path locus, therebetween;

actuating a cutter device, mounted upon one of said first and second clamping members, so as to sever a portion of the wrapping film clamped between said first and second clamping members and thereby free a trailing end portion of the wrapping film extending from a load being wrapped at the wrapping station such that the trailing end portion of the wrapping film can self-adhere to the wrapped load at the wrapping station, as well as to retain a leading end portion of the wrapping film extending to a supply of wrapping film in preparation for a new wrapping operation to be performed upon a new load to be wrapped at the wrapping station;

moving said actuating arm from said second extended position, adjacent to the wrapping film flow path locus, back to said first retracted position, remote from the wrapping film flow path locus, while said first and second clamping members are maintained at said relatively CLOSED position, such that the leading end portion of the wrapping film is maintained in a clamped condition between said first and second clamping members, so as to permit a new load to be wrapped to be disposed at the wrapping station;

moving said actuating arm from said first retracted position, remote from the wrapping film flow path locus, back to said second extended position, adjacent to the wrapping film flow path locus, while said first and second clamping members are maintained at said relatively CLOSED position, such that the leading end portion of the wrapping film is maintained in a clamped condition between said first and second clamping members; and moving said at least one of said first and second clamping members away from said other one of said first and second clamping members such that said first and second clamping members achieve said first OPENED position so that the clamped leading end portion of the wrapping film is released from its clamped position between said first and second clamping members and permitted to self-adhere to the new load to be wrapped at the wrapping station in conjunction with the performance of a new wrapping operation being performed upon the new load to be wrapped at the wrapping station.

25. The method as set forth in claim 24, further comprising the step of:

said at least one of said first and second clamping members is moved away from said other one of said first and second clamping members, such that said first and second clamping members achieve said first OPENED position whereupon the clamped leading end portion of the wrapping film is released from its clamped position between said first and second clamping members so as to self-adhere to the new load to be wrapped at the wrapping station, subsequent to a predetermined amount of wrapping film being wrapped around the new load to be wrapped at the wrapping station.

26. The method as set forth in claim 25, further comprising the step of:

moving said actuating arm from said second extended position, adjacent to the wrapping film flow path locus, back to said first retracted position, remote from the wrapping film flow path locus, subsequent to said movement of said first and second clamping members to said first OPENED position and to the predetermined amount of wrapping film being wrapped around the new load to be wrapped at the wrapping station.

* * * * *